US006237384B1

(12) United States Patent
Seidel

(10) Patent No.: US 6,237,384 B1
(45) Date of Patent: May 29, 2001

(54) METHOD OF AND INSTALLATION FOR SHAPING A METAL STRIP

(75) Inventor: Jürgen Seidel, Kreuztal (DE)

(73) Assignee: SMS Schloemann-Siemag AG, Düsseldorf (DE)

( * ) Notice: Subject to any disclaimer, the term of this patent is extended or adjusted under 35 U.S.C. 154(b) by 0 days.

(21) Appl. No.: 09/495,806

(22) Filed: Feb. 1, 2000

(30) Foreign Application Priority Data

Feb. 1, 1999 (DE) ..... 199 03 926

(51) Int. Cl.[7] ..... B21B 27/06
(52) U.S. Cl. ..... 72/201
(58) Field of Search ..... 72/200, 201, 202, 72/229, 205

(56) References Cited

U.S. PATENT DOCUMENTS

| | | | | |
|---|---|---|---|---|
| 4,534,198 | * | 8/1985 | Noe et al. | 72/201 |
| 4,653,303 | * | 3/1987 | Richard | 72/236 |
| 5,085,066 | * | 2/1992 | Komami et al. | 72/201 |
| 5,329,688 | * | 7/1994 | Arvedi et al. | 72/201 |
| 6,079,242 | * | 1/1999 | Allegro et al. | 72/8.6 |

* cited by examiner

*Primary Examiner*—Rodney A. Butler
(74) *Attorney, Agent, or Firm*—Brown & Wood, LLP

(57) ABSTRACT

A method of shaping a metal strip in a hot rolling installation including arranged one after another finishing train, cooling section, and coiler, with the method including providing, in a region between an end of the cooling section and the coiler, rolls for reducing a strip thickness, and reducing the thickness of the strip after the strip leaves the cooling section; and an installation for effecting the method.

3 Claims, 1 Drawing Sheet

METHOD OF AND INSTALLATION FOR SHAPING A METAL STRIP

BACKGROUND OF THE INVENTION

1. Field of the Invention

The present invention relates to a method of shaping a metal strip in a hot rolling installation including arranged one after another in a strip displacement direction finishing train, cooling section, and coiler, and to an installation for effecting the method.

2. Description of the Prior Art

It is well known to roll a metal strip, after casting, in a hot rolling installation to reduce the strip thickness to a certain thickness before a further reduction of the strip thickness to a final dimension in a cold rolling installation. The metal strip fed to the cold rolling installation should meet very high requirements with respect to its mechanical and geometrical characteristics, in particular, with regard to its surface evenness.

Simultaneously, there exists a tendency to impart the desired characteristics of a metal strip, which is obtained as a result of following one another, hot and cold rolling, already during the hot rolling, or to provide a hot rolled strip having optimal pre-conditions for the subsequent cold rolling process. Anyway, the boundary condition of the strip is more difficult to achieve during the hot rolling. It is desirable to adapt thinner and wider products to end products as much as possible, and such an adaptation requires a significant thickness reduction during the hot rolling which, in turn, requires application of larger rolling forces in the last rolling mill stands of the hot rolling train. However, application of large rolling forces in the last rolling mill stands of the hot rolling train adversely affects the flatness of the hot rolled strip and, thus, the quality of the strip in its cold condition.

The strip leaves the finishing train at least partially with a non-uniform flatness and/or stress distribution over the strip width. Further, the flatness and/or strip structure changes in the cooling section. The non-uniform characteristics of the hot rolled strip over the strip width lead, directly or indirectly, to different flatness characteristics of the cold strip.

Accordingly an object of the present invention is to provide a method of and an installation for shaping a metal strip which would insure obtaining a uniform flatness and stress distribution already in a hot rolled strip so that a flattened strip is obtained in the cold condition.

A further object of the present invention is to provide a method of and an installation for shaping a metal strip which would insure improved mechanical characteristics and surface structure of the hot rolled strip.

SUMMARY OF THE INVENTION

These and other objects of the present invention, which will become apparent hereinafter, are achieved by providing, in a hot rolling installation in a region between the end of the cooling section and the coiler, at least two rolls arranged one above an other and forming together a roll gap, which is smaller than a thickness of the strip before it enters the roll gap, and further reducing the strip thickness as the strip passes the roll gap between the two rolls. Thus, according to the present invention, the strip is subjected to an additional rolling step after it leaves the finishing train.

A small further thickness reduction is sufficient to eliminate the unflatness and the non-uniform stress distribution which characterize the strip after it leaves the finishing train and/or the cooling section, in particular, at a reduced coiling temperature. The additional thickness reduction significantly improves the quality of a strip in a cold condition.

However, a greater reduction is contemplated in order to further reduce the end thickness and to improve the structure or the mechanical characteristics of the strip.

The shaping of the strip in the finishing train is effected in the austenite or ferrite region. However, the subsequent rolling after the strip leaves the cooling section, as a rule, is effected in the ferrite region.

According to a first embodiment of the invention, the roll gap between the rolls of the (reinforced) pinch roll unit which, in this case, serves as an additional rolling mill stand, is so adjusted that the thickness reduction takes place in the driver itself. Thus, the pinch roll unit is used not only for advancing the strip but also for the thickness reduction.

According to a second embodiment of the invention an additional rolling mill stand with thickness reduction rolls is arranged in front of the driver rolls which also can be selectively operated only as advancing means or as both advancing and thickness reduction means. The additional rolling mill stand also can be designated as a skin-pass mill stand.

The rolling mill stands which provide for only a small thickness reduction are known as skin-pass stands. Arranging, according to the present invention, a skin-pass mill stand between the outlet of the cooling section and the coiler in a conventional hot rolling installation permits to achieve, due to a very small thickness reduction of the strip, averaging of the stress characteristics of the strip and, thereby, a higher degree of the flatness or another surface roughness before winding the strip up in a coiler. The provision, according to the present invention of a skin-pass mill stand insures averaging of the stress characteristics and, simultaneously, increases a front tension applied to the strip.

As a skin-pass mill stand, a two-high and four-high mill stand can be used. The diameters of the upper and lower rolls can be the same or different. The same applies to the driving rolls. The surface of the pinch rolls or of the skin-pass mill stand rolls can be smooth or roughened in order to obtain a desired roughness of the strip.

Advantageously, the driving rolls or the rolls of the additional rolling mill stand are associated with a control element for controlling the roll gap. The controlled parameters can include the ground shape of the rolls or a pressure force applied by the rolls. The controlled parameter can further include CVC-microsection or roll camber. As a further controlled parameter, cooling of the working rolls of the additional rolling mill stand can be used. For improving the quality of the roll surfaces, e.g., a multi-zone cooling, on-line grounding or polishing devices can be used.

For increasing the thickness reduction or for adjusting an obtained surface texture of the strip, the pinch roll unit or the skin-pass rolling mill stand can be associated with a device which provides for lubrication of the roll gap. As a control element, a zonal lubrication over the strip width is proposed.

It should be expected that with the use of the lubrication device, a nonburned residue of the lubricant, preferably oil, will remain on the strip. Therefore, it is contemplated to provide, together with a lubrication device, a device for removing the lubricant, e.g., a water spraying girder.

When a thickness reduction is effected by using a skin-pass mill stand, preferably, a further strip cooling section should be provided after the mill stand. The further cooling section can be equipped either with a low-pressure system or a high-pressure system. The value of such additional cooling system consists in that it not only provides for further cooling of the strip but also serves for removing roll rubbed-off particles and tertiary cinder, for further removal of the lubricant oil, and for additional modification of the strip characteristics.

For a better control of the thickness reduction in the skin-pass mill stand, a thickness measuring device is provided downstream of the skin-pass mill stand.

According to the present invention, advantageously, a flattening device is provided, in addition to the skin-pass mill stand, between the end of the cooling section and the coiler. The flattening device straightens the strip as it passes, with a substantial pulling force, over straightening and bending rolls which provide for deflection of the strip.

In a particularly preferred embodiment of the present invention, there is contemplated to provide, in order to obtain a more flattened strip, means for controlling the adjustment of the rolls of the skin-pass mill stand or of the driving rolls dependent on strip characteristics. The strip characteristics can include temperature distribution, strip profile, and/or tensile stress distribution. Those characteristics are determined cyclically at the end of the process and are used as control variables for changing the size of the roll gap.

In a similar manner, the adjustment of the flattening rolls of the flattening device relative to each other and to the strip is controlled dependant on the strip characteristics.

The thickness reduction over the strip length can be varied. Only a small reduction is desired at the strip head in order to temper the impact of the initial pass of the strip between the rolls. Then, the roll gap between the pinch rolls or the rolls of the skin-pass mill stand is reduced to a set thickness.

The proposed method and installation can be used for shaping strips made from different metals. In particular, the inventive method and installation are designed for shaping steel and aluminum strips.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
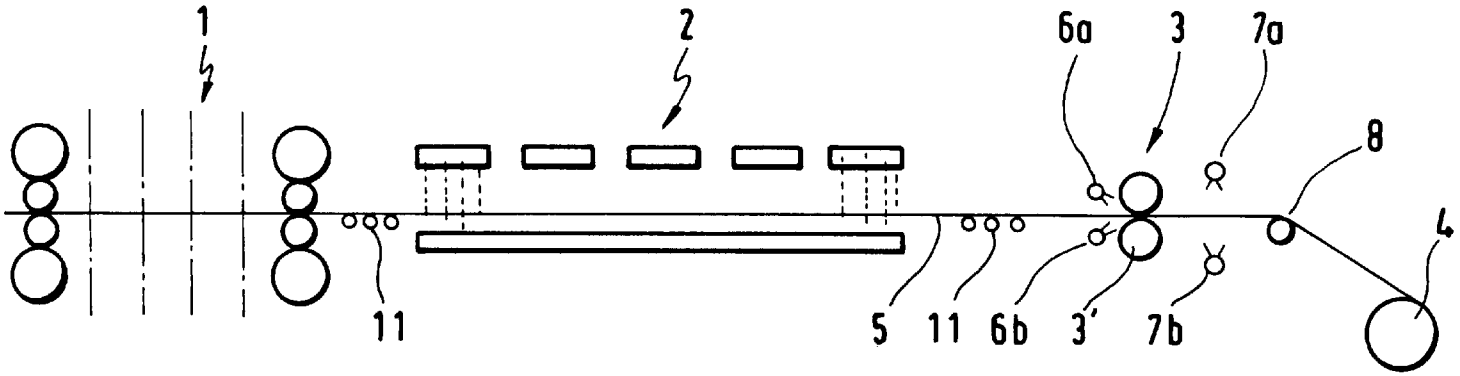
FIG. 1 a schematic view of an installation for shaping a metal strip according to the present invention with thickness-reducing driving rolls provided between the cooling path and a coiler.

FIG. 1 shows an installation for shaping a metal strip according to the present invention and including a finishing train 1, following cooling path 2, pinch rolls 3, and a coiler 4. The strip is designated with a reference numeral 5. In the installation shown in FIG. 1, the thickness reduction of the strip 5 is effected by a pinch roll stand 3' having pinch rolls 3. In front of the pinch roll stand 3', there is provided, viewing in the longitudinal direction, a lubrication device 6*a*, 6*b*, with a device 7*a*, 7*b* for removing the lubricant being provided downstream of the pinch roll unit 3. Downstream of the device 7*a*, 7*b*, there is advantageously provided a plate cooling device, not shown here. For feeding the strip into the coiler 4, there is provided a deflection roller 8 which can be formed as a flatness measuring roll.

Figure 2:
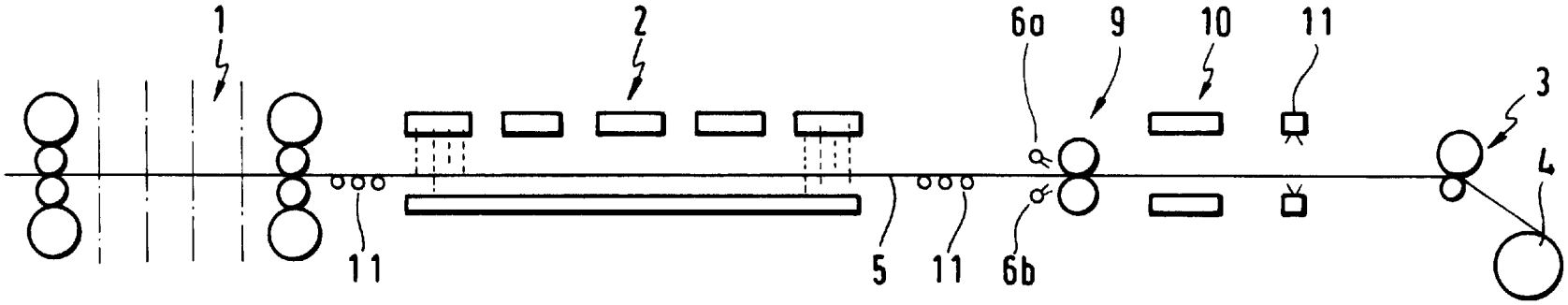
FIG. 2 a schematic view of an installation for shaping a metal strip according to the present invention with a skin-pass rolling mill stand provided between the cooling path and a coiler.

FIG. 2 shows another embodiment of the present invention in which the thickness reduction of the strip between the cooling path 2 and the coiler 4 is effected by a separate skin-pass mill stand. The strip 5, after it exits the finishing train 1, is displaced through the cooling section 2. Before being coiled, the strip 5 is subjected to one more thickness reduction in a skin-pass mill stand 9. In front of the skin-pass mill stand 9, there is provided a lubrication device 6*a*, 6*b*, and immediately after the skin-pass mill stand 9, there is provided a further cooling device 10. For controlling the thickness, there is provided a thickness measuring device 11. The thickness measuring device 11 is provided in front of the driver 3' with upper and lower rolls 3. Between separate elements of the installation, there are provided guide rollers 11 for the strip 5.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. An installation for shaping a metal strip, comprising arranged one after another, in strip displacement direction, a finishing train; a cooling section; a coiler; and at least two rolls provided in a region between an end of the cooling section and the coiler and arranged one above another, the two rolls forming together a roll gap smaller than a thickness of the strip before it enters the roll gap, wherein the at least two rolls form part of a rolling mill stand, and wherein the installation further comprises a two function pinch roll unit provided downstream of the rolling mill stand for advancing the strip to the coiler and for effecting reduction of the strip thickness.

2. An installation as set forth in claim 1, further comprising a further cooling section provided downstream of the rolling mill stand and upstream of the driver.

3. An installation as set forth in claim 1, further comprising thickness measuring means provided downstream of the rolling mill stand.

* * * * *